US009828928B2

(12) United States Patent
Auffret et al.

(10) Patent No.: US 9,828,928 B2
(45) Date of Patent: Nov. 28, 2017

(54) METHOD AND DEVICE FOR CONTROLLING THE OPERATING MODE OF AN INTERNAL COMBUSTION ENGINE, IN PARTICULAR OF A MOTOR VEHICLE

(71) Applicant: Robert Bosch GmbH, Stuttgart (DE)

(72) Inventors: Stephane Auffret, Markgroeningen (DE); Bettina Weber, Ilsfeld (DE)

(73) Assignee: ROBERT BOSCH GMBH, Stuttgart (DE)

( * ) Notice: Subject to any disclaimer, the term of this patent is extended or adjusted under 35 U.S.C. 154(b) by 8 days.

(21) Appl. No.: 15/019,674

(22) Filed: Feb. 9, 2016

(65) Prior Publication Data

US 2016/0230692 A1 Aug. 11, 2016

(30) Foreign Application Priority Data

Feb. 11, 2015 (DE) ..... 10 2015 202 425

(51) Int. Cl.
*F02D 41/26* (2006.01)
*F02D 41/30* (2006.01)
*F02D 41/24* (2006.01)

(52) U.S. Cl.
CPC ..... *F02D 41/3011* (2013.01); *F02D 41/2422* (2013.01); *F02D 41/263* (2013.01)

(58) Field of Classification Search
CPC . F02D 41/3011; F02D 41/263; F02D 41/2422
USPC ..... 701/102, 107, 115
See application file for complete search history.

(56) References Cited

U.S. PATENT DOCUMENTS

| | | | | |
|---|---|---|---|---|
| 9,073,545 | B2 * | 7/2015 | Whitney | B60W 10/06 |
| 9,180,870 | B2 * | 11/2015 | Whitney | B60W 10/06 |
| 9,316,163 | B2 * | 4/2016 | Okazaki | F02D 11/105 |
| 2016/0207518 | A1 * | 7/2016 | Meier | B60W 10/06 |

FOREIGN PATENT DOCUMENTS

| | | |
|---|---|---|
| DE | 102004041217 | 3/2006 |
| DE | 102005018270 | 10/2006 |

* cited by examiner

*Primary Examiner* — Hai Huynh
(74) *Attorney, Agent, or Firm* — Norton Rose Fulbright US LLP; Gerard Messina

(57) ABSTRACT

A method and a device for controlling an internal combustion engine, in particular of a motor vehicle, the internal combustion engine including components which are each operated in an operating mode established by an operating mode coordinator, and it being in particular provided that the operating mode coordinator carries out the aforementioned establishment of at least one operating mode based on further operating aspects of the components.

12 Claims, 3 Drawing Sheets

METHOD AND DEVICE FOR CONTROLLING THE OPERATING MODE OF AN INTERNAL COMBUSTION ENGINE, IN PARTICULAR OF A MOTOR VEHICLE

CROSS REFERENCE

The present application claims the benefit under 35 U.S.C. §119 OF German Patent Application No. 102015202425.3 filed on Feb. 11, 2015, which is expressly incorporated herein by reference in its entirety.

FIELD

The present invention relates to a method and to a device for controlling operating modes of an internal combustion engine, in particular of a motor vehicle. The present invention further relates to a computer program, to a machine-readable data carrier for storing the computer program, and to an electronic control unit with the aid of which the method according to the present invention may be carried out.

BACKGROUND INFORMATION

Spark ignition internal combustion engines, in particular direct injection internal combustion engines, are operated in different operating modes. These operating modes differ in the mixture formation, for example, and thus in the application strategy and in software functions for the fuel injection system, the air system and/or the ignition system. The application data for the operating mode-specific functions are stored in different setpoint value characteristic map structures. The change to a certain operating mode depends on the operating point of the internal combustion engine and/or the present state of the drive train and/or of the motor vehicle and/or on environmental conditions.

In modern direct injection internal combustion engines, in particular in diesel internal combustion engines, exhaust after-treatment systems are additionally used, or new combustion methods for lowering emissions are provided. A so-called operating mode coordinator (state machine) has been adapted to such an exhaust after-treatment, different application strategies and operating mode-specific software functions being used, which are switched as a function of the operating state of the internal combustion engine and/or as a function of the environmental conditions.

In spark ignition internal combustion engines, an aforementioned operating mode coordinator has been used to select fuel-efficient operating modes, and in the case of direct injection internal combustion engines including a particulate filter, it has also been used to achieve optimal regeneration of the particulate filter. Compared to an operating mode "low fuel consumption," for example, the operating mode "regeneration of the particulate filter" in many cases has a considerably higher priority.

An aforementioned operating mode coordinator is described in German Patent Application No. DE 10 2004 041 217 A1. There, the operating mode coordinator processes a piece of priority information, in addition to the request for an operating mode. The processing sequence of the request is not established, but is variable due to the additional priority information. Before the request is processed within the operating mode coordinator, the coordinator sorts the requests according to their priority, which may be predefined.

Furthermore, an operating mode coordinator operating according to the principle of negative exclusion logic is described in German Patent Application No. DE 10 2005 018 270 A1, which selects from the operating mode requests those requests having the highest priority which are not prohibited by other operating mode requests. This allows an operating mode coordination which is independent of the particular configuration of the motor vehicle and of the exhaust after-treatment.

SUMMARY

The present invention is based on providing additional information from operating point requesters to an operating mode coordinator affected here, or of collecting such information in a suitable manner in only one central coordinator, so that the same makes a described global or overall optimal coordination of the different operating modes possible.

The present invention is in particular based on the finding that in an operating mode coordinator according to the related art affected here, the sequence in the admission of a certain operating mode is established via a fixedly predefined priority, i.e., the priority of the operating states is not variable or a single final decision for requested operating modes must be made for each application. Alternatively, there is a calculation; however, it takes place uncoordinated with respect to the individual components or individual requesters.

In a compression ignition internal combustion engine (diesel engine), the sequence is established via an at least applicable priority, which in individual cases is dynamically calculated. Regenerating a particulate filter is always more urgent, for example, than thawing an SCR system used for "selective catalytic reduction" by heating, i.e., the priority of the operating mode mentioned first will be relatively high compared to the other operating mode.

A central coordinator is required for different operating aspects or operation coordination aspects, such as the fuel consumption, the exhaust after-treatment, the operating or driving comfort, the component protection, the operation with the aid of a driving speed control (cruise control), the load point shift occurring during acceleration of the motor vehicle, or other integrally important aspects for the operation of the internal combustion engine or of the motor vehicle, since an optimization of only each individual component would not result in an integrally optimal result or concept.

The present invention now provides for carrying out the coordination of operating states of an internal combustion engine with the aid of an aforementioned central operating mode coordinator, preferably based on an additional criteria catalog or a criteria list, which provides further or supplemental information about the aforementioned operation coordination aspects for the individual operating point requesters. An aforementioned criteria catalog preferably includes information about effects, i.e., contributions or influences (hereafter "criteria") of individual components of the internal combustion engine or of the motor vehicle or of corresponding operating mode requests, on the operation of the internal combustion engine or of the motor vehicle.

The central operating mode coordinator additionally evaluates the aforementioned further information to the effect that operating point requesters having identical or similar criteria are assigned to each other, so that it may be checked in the case of an operating point inquiry of an operating point requester whether there is at least one second operating point requester having an identical or similar criterion, so that the grant of a corresponding operating point may be made dependent on the operating state of the at least second operating point requester competing in this regard. The central operating mode coordinator may thus either not approve such a renewed operating point inquiry in the first place, or revoke or rescind an already approved operating point inquiry or a requested, generally similarly acting operating mode by an operating point requester competing in the described manner. In the latter case, the renewed operating point inquiry may thus be allowed, so that ultimately only one of the at least two operating point requesters is active at a given point in time or is operated in the requested operating mode.

The aforementioned supplemental pieces of information or criteria are above-mentioned operating aspects or operation coordination aspects, in particular a contribution of a particular operating point requester to the NOx reduction and/or particulate emission reduction, an influence of a particular operating point requester on the fuel consumption and/or the dynamic behavior of the internal combustion engine and/or the efficiency of a functional component of the internal combustion engine.

Based on the aforementioned supplemental or further pieces of information, improvements, which are described in detail hereafter, in the operating behavior of an internal combustion engine or a motor vehicle affected here may be achieved.

The method according to the present invention thus in particular provides that the operating mode coordinator, for a request of a first component, determines the priority underlying the selection of the request based on at least one operating aspect of the first component and at least one corresponding or competing operating aspect of at least one second component. This expanded functionality of the operating mode coordinator may advantageously be implemented by a relatively minor modification of an existing operating mode coordinator.

According to the present invention, the prioritization of operating modes consequently no longer follows a standard prioritization or a standard ranking which is carried out in accordance with the related art, e.g., emissions being given higher priority than fuel efficiency, generally a dynamics reserve being provided, and/or generally each exhaust gas component being optimally operated, but is adapted to the particular operating situation. The prioritization according to the present invention is carried out, for example, in that it is considered whether, e.g., a dynamics reserve is even necessary since the motor vehicle is already being operated with the aid of a driving speed control (cruise control), for example, or whether, e.g., particulate emissions at a present operating point in time are more problematic than NOx emissions, in the case of a spark ignition internal combustion engine (gasoline engine) the particulate mass being modelable for this assessment, and in the case of a compression ignition internal combustion engine (diesel engine) the state of a particulate filter being checkable for this assessment.

It should be noted that, according to the present invention and contrary to the related art, the operating mode requesters do not predefine priorities or carry out the prioritization, but that the priority is centrally calculated or determined by the operating mode coordinator based on their dynamically calculated and provided aforementioned operating aspects or additional pieces of information.

It may further be provided in the example method according to the present invention that the operating mode coordinator selects at least one request having the highest priority from operating mode requests of the components, that the operating mode coordinator, for a selected request of a first component, additionally carries out the aforementioned establishment of the at least one operating mode based on at least one operating aspect of the first component and on at least one corresponding operating aspect of at least one second component.

According to one embodiment of the method according to the present invention, the operating mode coordinator carries out the following steps:

- collecting all operating mode requests and buffering the collected operating mode requests, e.g., in a first buffer;
- sorting the collected operating mode requests according to their priorities and buffering the sorted operating mode requests, e.g., in the first buffer or in a second buffer;
- selecting at least one operating mode request using negative exclusion logic;
- checking the at least one selected operating mode request for possible corresponding or competing operating modes; [and]
- granting the operating mode request made or rescinding an already granted operating mode request as a function of the result of the check.

The present invention also relates to a device operating according to the aforementioned method and including an aforementioned operating mode coordinator, the device in particular providing that the operating mode coordinator processes aforementioned further operating aspects of the components and, for a selected request, establishes at least one operating mode based on at least one of the aforementioned further operating aspects. Such a device may also be implemented with only a minor modification of a corresponding device.

The present invention may be used in an internal combustion engine including an operating mode coordinator, in particular including an operating mode coordinator using negative exclusion logic, with the advantages described herein.

The computer program according to the present invention is configured to carry out every step of the method, in particular if it runs on a computer or a control unit. It allows the method according to the present invention to be implemented on an electronic control unit, without having to carry out structural changes thereto. The machine-readable data carrier is provided for this purpose, on which the computer program according to the present invention is stored. The electronic control unit according to the present invention is obtained by installing the computer program according to the present invention in an electronic control unit, which is configured to control different operating modes of an internal combustion engine, in particular of a motor vehicle, with the aid of the method according to the present invention.

Further advantages and embodiments of the present invention are described below and are shown in the figures.

It shall be understood that the above-mentioned features and those still to be described hereafter may be used not only in the particular described combination, but also in other combinations, or alone, without departing from the scope of the present invention.

DETAILED DESCRIPTION OF EXAMPLE EMBODIMENTS

Figure 1:
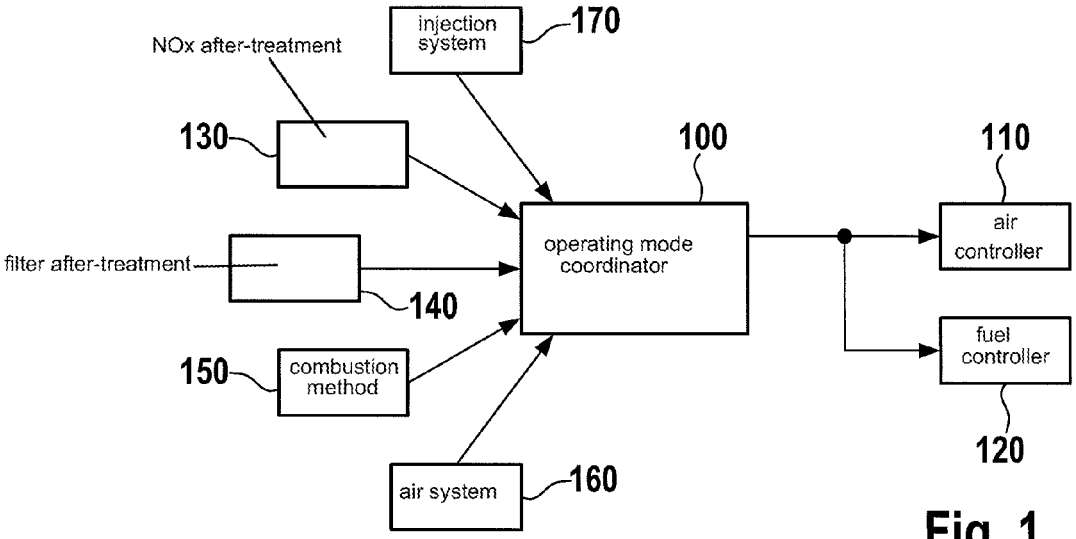
Fig. 1 Related Art
FIG. 1 schematically shows a device for controlling an internal combustion engine according to the related art.

A device for controlling an internal combustion engine which is shown in FIG. 1 from the related art includes an air controller 110 and a fuel controller 120. Air controller 110 and fuel controller 120, and possibly further systems (not shown), are activated by an operating mode coordinator 100 as a function of a selected operating mode. Operating mode coordinator 100 is supplied with signals from different sub-systems, for example of NOx after-treatment 130, particulate filter after-treatment 140, a certain combustion method 150, and further signals, for example of an air system 160 or injection system 170. Operating mode coordinator 100 coordinates the operating mode and switches between the selected operating modes to apply signals to air controller 110 and/or fuel controller 120. Moreover, additional signals (not shown), such as the torque request, may be applied to air controller 110 and/or fuel controller 120.

Figure 2:
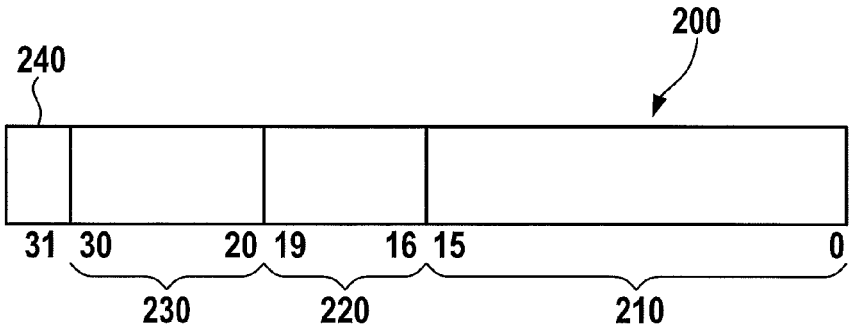
Fig. 2 Related Art
FIG. 2 schematically shows the structure of an operating mode request according to the related art.

The operating mode coordination takes place in the conventional manner by selecting an operating mode request as a function of a priority, that operating mode request which has the highest priority and is not prohibited by other operating mode requests being selected from multiple operating mode requests. For this purpose, every operating mode request, as is shown, e.g., in FIG. 2, is represented as a 32-bit variable. However, it shall be understood that the present invention is not limited thereto, but that, for example, 64-bit variables may also be used, or variables having another suitable form, e.g., structures (combinations of multiple variables). Every operating mode request 200 in the form of the 32-bit variable has a bit-coordinated operating mode mask 210, which occupies positions 0 through 15 of the 32-bit variable, for example, a priority 220, which occupies positions 16 through 19 of the 32-bit variable, for example, and a bit-coordinated stage 230 of the operating mode, which occupies positions 20 through 30, for example. Moreover a further bit, which in the present case is position 31 of the 32-bit variable, may be provided as selection variable 240 for a direct operating mode change. In principle three types of operating mode requests are possible:

1. a concrete request for a certain operating mode;
2. prohibitions of certain operating modes;
3. no request of an operating mode.

The priority of every operating mode request 200 may be dynamically adapted to the present circumstances. For this purpose, the component requesting a certain operating mode may increase the priority if the urgency is high, or set a lower priority level if the urgency of the request is lower. In contrast to fixedly predefined priorities, in this way the system behavior may be changed simply by adapting the priorities.

A concrete request for a certain operating mode may be implemented on operating mode mask 210, which stands for the desired operating mode. The urgency of the requests is established at the positions assigned to priority 220. The desired stage of the operating mode is set at the positions characterizing the information of the stage of operating mode 230.

To implement a prohibition of operating modes, only those bits of the operating modes which correspond to these operating modes which are still to be allowed/possible are set in operating mode mask 210. Here, priority 220 must be set to the highest priority. A piece of stage information, i.e., a piece of information of the stage of operating modes 230, is not necessary for this purpose and may be set to zero in this case.

If no request of an operating mode is to be implemented at all, all bits are set in operating mode mask 210. The priority in this case is also to be set to the highest priority, as with the prohibition of operating modes.

Figure 3:
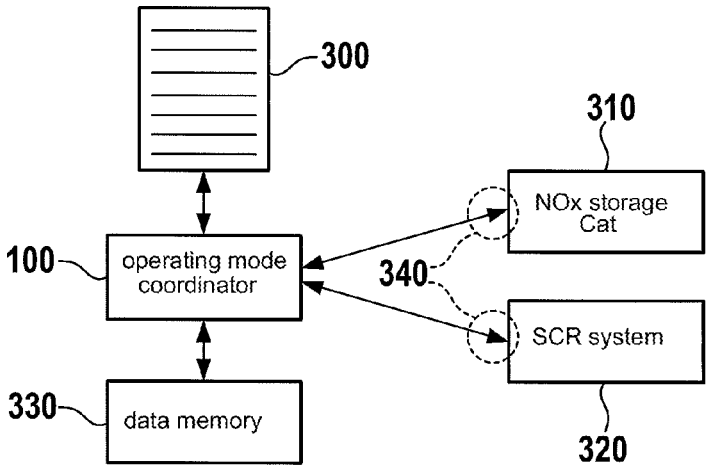
FIG. 3 schematically shows an example method using the present invention or a device for operating mode coordination based on a combined flow chart/block diagram.
Figure 4:
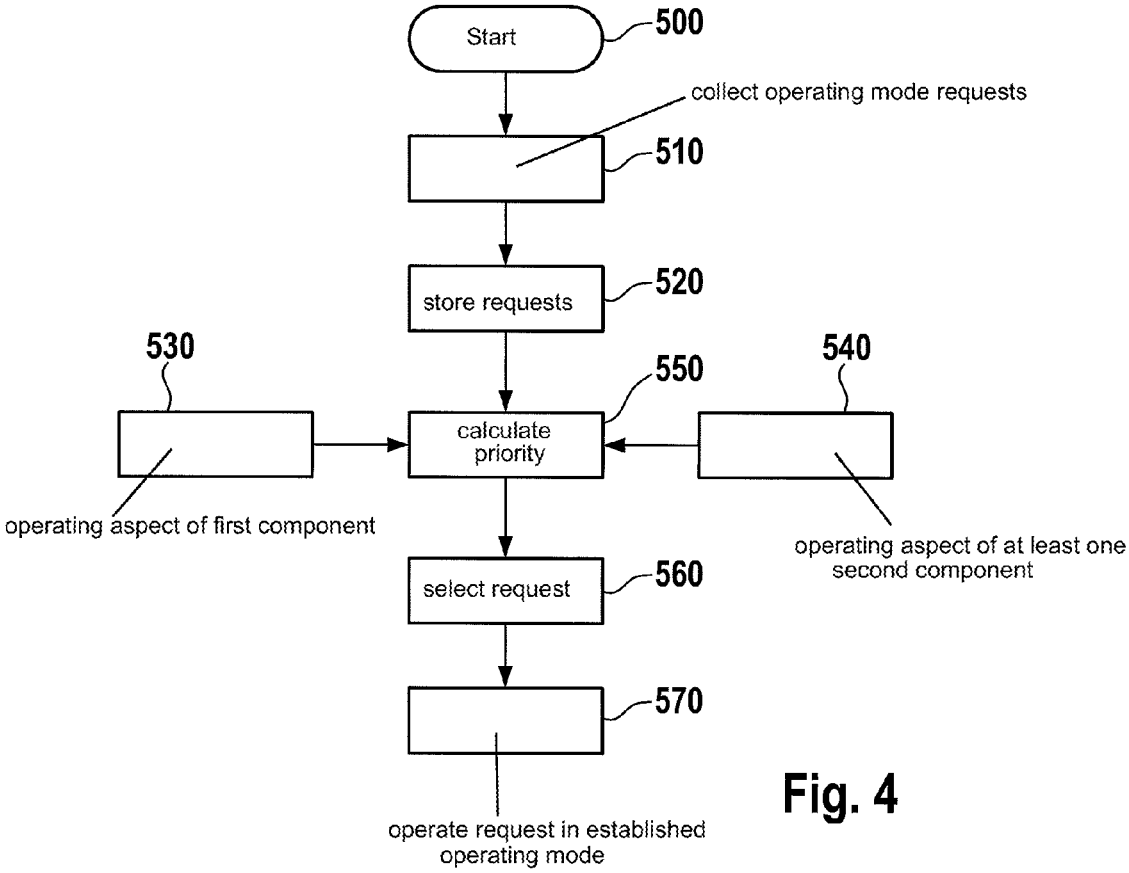
FIG. 4 shows a first exemplary embodiment of the operating mode selection according to the present invention based on a flow chart.

The course of an operating mode coordination according to an example embodiment of the present invention and a corresponding device are explained hereafter in conjunction with FIG. 3 and FIG. 4.

The exemplary embodiment of a device according to the present invention shown in FIG. 3 includes an aforementioned operating mode coordinator 100, which in the present exemplary embodiment is connected to or cooperates with an aforementioned criteria catalog 300 for a bidirectional data exchange. Operating mode coordinator 100 is furthermore also bidirectionally connected to a data memory 330.

For simplification purposes, operating mode coordinator 100 in the present example is only connected to two components of an internal combustion engine, namely to an NOx storage Cat (catalytic converter) 310 and an SCR system 320. The data exchange with components 310, 320 takes place bidirectionally in the exemplary embodiment, but may also take place only unidirectionally omitting the two arrow directions 340, components 310, 320 supplying their respective operating mode requests, e.g., in "push" operation, to operating mode coordinator 100, whereas in the bidirectional operation corresponding requests, e.g., may be transmitted from operating mode coordinator 100 to the respective component.

The following table shows one exemplary embodiment of an aforementioned criteria catalog or criteria list. The left column lists all components of an affected internal combustion engine or of a corresponding motor vehicle (of which only four components are explicitly listed in the table) which are able to send operating mode requests to an aforementioned operating mode coordinator 100. The four criteria listed by way of example in the four right columns refer to the particular contribution or influence of the particular criterion or operating aspect (e.g., fuel consumption, dynamics of the acceleration, and exhaust gas emissions of soot particles and nitrogen oxides). The characteristic values listed in the four right columns starting with line 2 are selected from the characteristic value range [−5, +5] in the present exemplary embodiment and indicate how large the aforementioned contribution or the influence of the particular component generally is on the particular operating aspect, the average characteristic value of zero representing a neutral contribution or influence, a negative value indicating a negative influence, and a positive value indicating a positive influence. It shall be emphasized that the characteristic values listed in the table serve only illustration purposes, and that the shown values (or the value range from −5 to +5) are provided only by way of example.

TABLE

Exemplary embodiment of a criteria catalog according to the present invention

| Component | [Fuel] Consumption | Dynamics | Particles | NOx |
|---|---|---|---|---|
| NOX storage Cat | −1 | −1 | 0 | +5 |
| SCR system | −1 | −1 | 0 | +4 |
| Particulate filter | 0 | −1 | +5 | 0 |
| Cruise control | +3 | −5 | −2 | −2 |
| . . . | . . . | . . . | . . . | . . . |

FIG. 4 shows a first exemplary embodiment of the method according to the present invention based on a flow chart. After the start 500 of the shown routine, in a first step 510 all operating mode requests which are present in the system and made by different components are collected by operating mode coordinator 100 and stored 520 in a buffer of a data memory. Operating mode coordinator 100 processes the stored requests in such a way that, for a request of a first component 310, the priority underlying the selection of the request is calculated 550 based on at least one operating aspect 530 of first component 310 and at least one corresponding operating aspect 540 of at least one second component 320. Based on the priority thus determined 550, operating mode coordinator 100 selects 560 at least one request from stored operating mode requests 200 of components 310, 320, the request thus selected thereafter being operated 570 in an operating mode established by operating mode coordinator 100.

Figure 5:
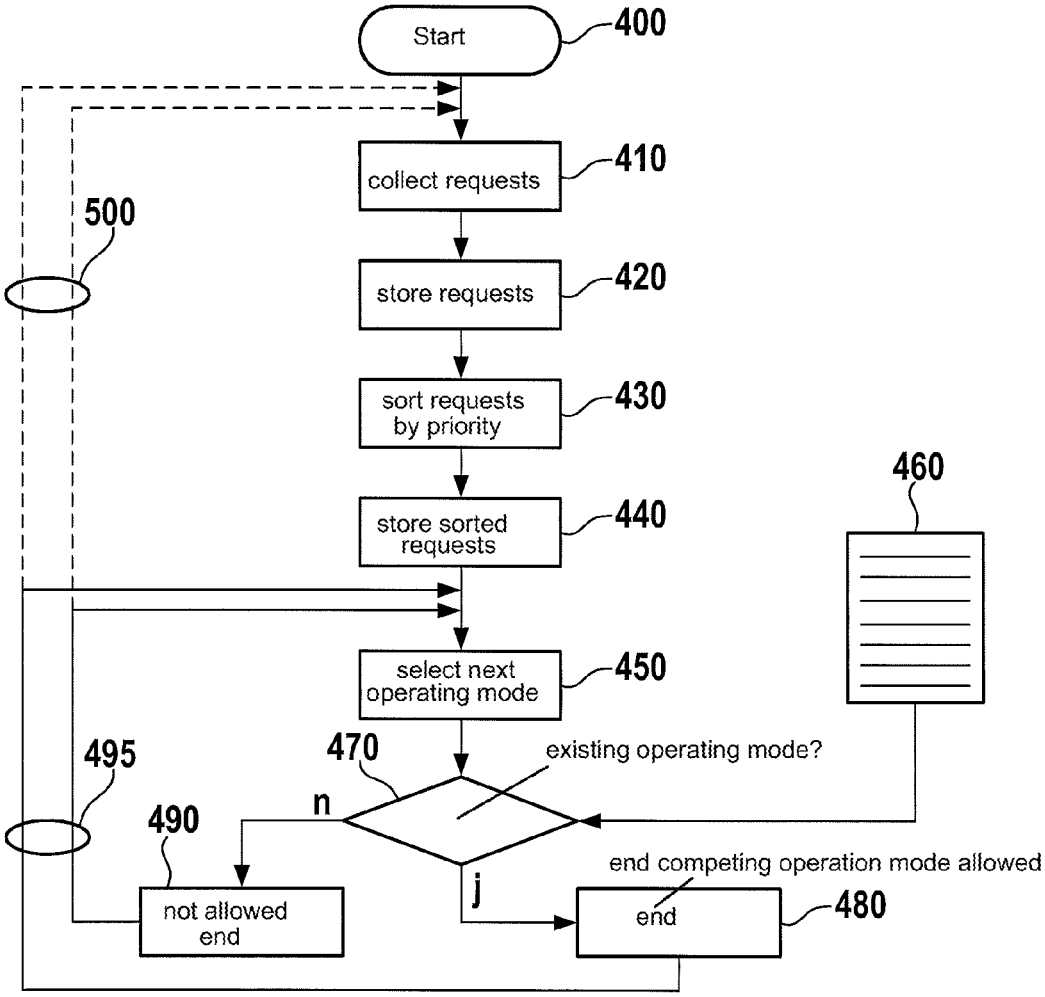
FIG. 5 shows a second exemplary embodiment of the operating mode selection according to the present invention based on a flow chart.

FIG. 5 shows a further possible routine for the operating mode selection according to the present invention. After the start 400 of the routine, in a first step 410 all operating mode requests 200 present in the system are collected by operating mode coordinator 100 and stored 420 in a first buffer or in a first buffer area of a data memory including multiple memory areas. The operating mode requests thus stored are sorted according to their priority in a circuit part of a corresponding device shown in FIG. 3, or in step 430. Operating mode requests 200 stored 420 in the buffer are sorted according to their priority with the aid of a suitable sorting method and stored 440 in a second buffer or in a second buffer area of an aforementioned data memory.

In a further step 450, the next operating mode is selected, and in particular in the present exemplary embodiment by an aforementioned negative exclusion or selection logic. Based on an above-described criteria catalog 460, the operating mode selected 450 next is checked 470 as to whether there is an existing operating mode or process which meets, or at least partially meets, the criteria listed in the criteria catalog for the operating mode to be checked 470. If this is the case, either the existing (competing) operating mode or the corresponding process is ended and the re-checked 470 operating mode is allowed or the re-checked 470 operating mode is not allowed, however the existing operating mode or the existing process is maintained.

After the routine has ended 480, 490, it jumps back 495 to before step 450, and a next operating mode is selected in step 450 in the second buffer from the operating modes stored 440 there with the aid of the negative exclusion logic method. If the second buffer is empty, a jump back to the start (prior to step 410 in the present example) according to dotted line 500 takes place in order to carry out aforementioned steps 410 through 480 or 490 again.

It should be noted that another logic may also be used to select an operating mode instead of the negative selection logic, and that the sequence of the steps shown in FIG. 5 is shown only by way of example and in the present example the exact sequence of the steps is not important. For example, checking step 470 may also take place prior to the selection of a next operating mode using the negative selection logic.

The operating mode coordinator consequently determines the operating modes according to the following steps:

collecting all operating mode requests and storing these in a first buffer;

sorting the collected operating mode requests according to their priorities and storing the sorted operating mode requests in the first buffer or in a second buffer;

selecting operating mode requests, e.g., with the aid of negative exclusion logic;

checking the selected operating mode requests for possible competing operating modes based on an aforementioned criteria catalog; and allowing or not allowing a selected operating mode request or an existing, competing operating mode as a function of the result of the check.

The operating mode coordination therefore takes place as in the related art with the aid of a negative exclusion logic based on prioritized operating mode requests from the components which influence the present operating mode and, according to the present invention, additionally based on an aforementioned criteria catalog with the aid of which competing or similarly acting operating modes with respect to at least one operating criterion are detected and are treated in the described manner.

The priority assigned to an operating mode request is preferably dynamically adapted to present operating states of the internal combustion engine and/or to present environmental conditions. For this purpose, for example, the component requesting a certain operating mode may increase the priority if the urgency is high, or set a lower priority level if the urgency of the request is lower. Compared to the method known from the related art, this has the advantage that the priority is not fixedly predefined, but the system behavior may be changed by adapting the priorities.

A few examples are provided hereafter for operating point requesters or components competing within the scope of the present invention:

1. An NOx storage Cat and SCR system installed in a motor vehicle. During the startup process, the exhaust system is heated by the SCR system. However, if the contribution of the NOx storage Cat to the reduction of nitrogen oxides is sufficiently high, the heating of the SCR system may be dispensed with, whereby energy and therefore also fuel is saved.
2. An NOx storage Cat must be regularly regenerated as soon as it is fully loaded. If the efficiency of another component for exhaust gas purification or reduction (e.g., an aforementioned SCR system) is sufficiently high, an aforementioned regeneration may be dispensed with.
3. If a driving speed control is present and active, there is no need to provide a relatively large dynamics reserve in the internal combustion engine. In a spark ignition internal combustion engine (gasoline engine), for example, a transition may be made to a better ignition angle. In the case of a compression ignition engine (diesel engine), it is possible to move to operating points which result in lower exhaust gas emissions, but are usually avoided when a large dynamics reserve of the internal combustion engine is desired.
4. In particular in the field of commercial vehicles so-called transient corrections are known, with the aid of which an optimized operation of the internal combustion engine is achieved during load changes. The approaches available there always relate only to one aspect of the operating behavior. The operation of such an internal combustion engine may be even better optimized with a comprehensive or global coordination according to the present invention with respect to the operating point requester.

The described method may be implemented in the form of a control program for an electronic control unit for controlling an internal combustion engine or in the form of one or multiple corresponding electronic control units (ECUs).

What is claimed is:

1. A method for controlling an internal combustion engine of a motor vehicle, the internal combustion engine including components which are operated in an operating mode established by an operating mode coordinator, the method comprising:

selecting, by the operating mode coordinator, at least one request based on a priority from operating mode requests of the components; and determining, by the operating mode coordinator, a request of a first component the priority underlying the selection of the request based on at least one operating aspect of the first component and at least one corresponding operating aspect of at least one second component.

2. The method as recited in claim 1, wherein the operating mode coordinator selects at least one request having the highest priority from operating mode requests of the components, the operating mode coordinator, for a selected request of a first component, establishing the at least one operating mode based on at least one operating aspect of the first component and at least one corresponding operating aspect of at least one second component.

3. The method as recited in claim 1, wherein the operating aspects include at least one of contributions and influences of the components on the operating behavior of at least one of the internal combustion engine and the motor vehicle.

4. The method as recited in claim 1, wherein the operating aspects are contained in a criteria catalog which the operating mode coordinator accesses.

5. The method as recited in claim 4, wherein the criteria catalog includes at least one of: i) the respective contributions, and ii) influences of the characteristic values characterizing the components, based on which operating aspects of the first component making an operating mode request are compared to operating aspects of already granted operating modes of the at least one second component, and the at least one operating mode is established as a function of the result of the comparison.

6. The method as recited in claim 5, wherein the characteristic values of the operating aspect are compared, and either the already granted operating mode is revoked or the selected request is disallowed in the event that a comparison result drops below a predefined deviation.

7. The method as recited in claim 1, wherein the operating aspects include at least a contribution of one component to at least one of: i) reduction of exhaust gas emissions, ii) fuel consumption, iii) comfort, iv) dynamic behavior of the internal combustion engine, and v) the efficiency of the component.

8. The method as recited in claim 1, wherein the operating mode coordinator determines the operating modes according to the following:

collecting all operating mode requests and buffering the collected operating mode requests;

sorting the operating mode requests according to their priorities and buffering the sorted operating mode requests;

selecting at least one operating mode request using negative exclusion logic;

checking the at least one selected operating mode request for possible corresponding or competing operating modes; and granting the operating mode request made or rescinding an already granted operating mode request as a function of the result of the check.

9. The method as recited in claim 1, wherein the selection of a request having a highest priority takes place according to a negative exclusion logic, the request not being prohibited by at least one other operating mode request.

10. A device for controlling an internal combustion engine, the internal combustion engine including components and an operating mode coordinator, the operating mode coordinator configured to select a request having a highest priority from operating mode requests of the components, the priority being based on at least one operating aspect of a first component, and at least one operating aspect of a second component, the operating mode coordinator configured to process the operating aspects of the components and, for a selected request, establish at least one operating mode based on at least one of the operating aspects.

11. A machine-readable data carrier on which a computer program is stored, the computer program, when executed by a processor, causing the processor to perform:

selecting, by the operating mode coordinator, at least one request based on a priority from operating mode requests of the components; and determining, by the operating mode coordinator, for a request of a first component the priority underlying the selection of the request based on at least one operating aspect of the first component and at least one corresponding operating aspect of at least one second component.

12. An electronic control unit, which is configured to control an internal combustion engine including an operating mode coordinator for establishing an operating mode, the electronic control unit configured to perform:

selecting, by the operating mode coordinator, at least one request based on a priority from operating mode requests of the components; and determining, by the operating mode coordinator, for a request of a first component the priority underlying the selection of the request based on at least one operating aspect of the first component and at least one corresponding operating aspect of at least one second component.

* * * * *